United States Patent [19]

Long

[11] Patent Number: 4,988,667

[45] Date of Patent: Jan. 29, 1991

[54] RESISTIVE RIBBON WITH LUBRICANT SLIPPING LAYER

[75] Inventor: Michael E. Long, Penfield, N.Y.

[73] Assignee: Eastman Kodak Company, Rochester, N.Y.

[21] Appl. No.: 446,503

[22] Filed: Dec. 5, 1989

[51] Int. Cl.[5] ..... B41M 5/35; B41M 5/20

[52] U.S. Cl. ..... 503/227; 400/120; 428/195; 428/341; 428/447; 428/488.4; 428/704; 428/913; 428/914

[58] Field of Search ..... 400/120; 428/195, 341, 428/447, 484, 488.1, 488.4, 704, 913, 914; 503/227

[56] References Cited

U.S. PATENT DOCUMENTS

| | | | |
|---|---|---|---|
| 4,329,071 | 5/1982 | Applegate et al. | 400/120 |
| 4,456,915 | 6/1984 | Crooks et al. | 346/76 PH |
| 4,477,198 | 10/1984 | Bowlds et al. | 400/120 |
| 4,557,616 | 12/1985 | Dove et al. | 400/120 |
| 4,753,921 | 6/1988 | Henzel | 503/227 |
| 4,800,399 | 1/1989 | Long et al. | 346/76 PH |
| 4,810,119 | 3/1989 | Afzali-Ardakani et al. | 400/241.1 |
| 4,915,519 | 4/1990 | Afzali-Ardakani et al. | 400/120 |

OTHER PUBLICATIONS

Derwent Publications 86-003647/01 (Abstract for Kokai 60-229795).

Derwent Publications 84-314798/51 (Abstract for Kokai 59-196291).

*Primary Examiner*—Bruce H. Hess

*Attorney, Agent, or Firm*—Andrew J. Anderson

[57] ABSTRACT

A resistive ribbon dye-donor element for resistive ribbon dye transfer is made up of a resistive support bearing a liquid lubricant containing slipping layer on one side of the resistive layer, and a conductive layer and a dye-containing layer on the other side of the resistive layer. The resistive ribbon dye-donor is brought into contact with a dye-receiving element, and a dye transfer image is formed by imagewise supplying current to the dye-donor element to resistively heat it and cause dye to be transferred to the dye-receiving element.

20 Claims, No Drawings

RESISTIVE RIBBON WITH LUBRICANT SLIPPING LAYER

FIELD OF THE INVENTION

The present invention relates to resistive ribbon thermal dye-donor elements used in thermal dye transfer, and more particularly to lubricants used as slipping layers for such elements.

BACKGROUND OF THE INVENTION

In resistive ribbon thermal dye transfer, a ribbon made from a resistive support, a conducive layer, and a dye-containing layer is placed face-to-face with a dye-receiving element. Current is supplied to the resistive support by an electrode or array of electrodes and returns to ground via the conductive layer. The electric current is converted to heat through the resistive heating of the ribbon, and the hat causes dye in the dye-containing layer to be transferred to the dye-receiving element through the processes of dye diffusion, dye sublimation, or melting of the dye-containing layer. By imagewise controlling the current supplied, a desired dye image can be transferred.

Dye transfer may be performed as an essentially binary process, wherein the effect of the applied current is to transfer either all or none of the dye in the dye layer at the point where the current is supplied. Wax transfer is an example of such a binary process. Alternatively, the current applied to the electrodes may be varied in order to control the heat levels applied to the transferable dye and thereby control the amount of dye transferred in order to form continuous tone images of variable dye density. U.S. Pat. No. 4,800,399 discloses such a continuous tone resistive ribbon printing system, the disclosure of which is hereby expressly incorporated by reference.

During the resistive ribbon thermal dye transfer process, the resistive support comes in contact with the printing electrode(s) which supply the current. In order to reduce ribbon and printing electrode damage, reduce friction, and loosen material which builds up at the printing electrodes, it is known to use graphite as a coating on the resistive ribbon in a binary process as disclosed in U.S. Pat. No. 4,477,198 (Bowlds et al.). While graphite is a well-known solid lubricant, its use as a coating or "slipping " layer does not give a satisfactory image quality in application to continuous one resistive ribbon color printing.

Liquid lubricants have been suggested for use in slipping layers for thermal dye transfer using thermal heads, e.g. Japanese Kokais No. 59-196291 (Matsushita Electric Ind.) and No. 690-2297595 (Matsushita Electric Ind.; Mitsubishi Chem. Ind.), but the prior art does not suggest their use in resistive ribbon technology nor the superior results obtained in resistive ribbon technology as compared to use of solid lubricants.

SUMMARY OF THE INVENTION

Accordingly, it is an object vie of this invention to provide an improved resistive ribbon dye transfer element which enables dye transfer images of high quality to be achieved by continuous tone resistive ribbon color printing.

It is an additional object of this invention to provide an improved dye transfer process using such an improved resistive ribbon.

It is a further object of this invention to provide an improved resistive ribbon dye transfer assemblage made up of such an improved resistive ribbon and a dye-receiving element.

These objects are achieved by using a liquid lubricant in the slipping layer of a resistive ribbon dye-donor transfer element. While solid lubricant slipping layers produce images with defects including streaks, splotches, donor-receiver deformation and low transferred density, the use of liquid lubricants has been found to surprisingly enable virtually defect-free transferred images. Representative liquid lubricants within the invention includes siloxane based compounds such as polysiloxanes, silicone fluids and siloxane copolymers, aliphatic polyoxyethylene partial phosphate esters, hydrocarbon based compounds, and fatty acid ester oils such as castor oil and linseed oil.

Thus, in one embodiment, this invention comprises a resistive ribbon dye-transfer element comprising a resistive support bearing a slipping layer on one side of the resistive support, and a conductive layer and a dye layer on the other side of the resistive support, wherein the slipping layer comprises a liquid lubricant.

In another embodiment, this invention comprises a process of forming a dye-transfer image comprising the steps of (a) bringing into contact (i) a dye-receiving element and (ii) a dye-donor element comprising a resistive support bearing a slipping layer on one side of the resistive support and a conductive layer and a dye-containing layer on the other side of the resistive support, and (b) imagewise supplying current to the dye-donor element to resistively heat the dye-donor element thereby causing dye from the dye-containing layer to be transferred from the dye-donor element to the dye-receiving element to form the dye-transfer image, wherein the slipping layer comprises a liquid lubricant.

In a further embodiment, this invention comprises a resistive ribbon dye transfer assemblage comprising (a) a dye-donor element comprising a resistive support bearing a slipping layer on one side of the resistive support, and a conductive layer and a dye layer on the other side of the resistive support, and (b) a dye-receiving element comprising a dye image-receiving layers in contact with the dye layer, wherein the slipping layer comprises a liquid lubricant.

DESCRIPTION OF THE PREFERRED EMBODIMENTS

The resistive ribbon dye-transfer element of the invention includes a resistive material support layer baring a liquid lubricant slipping layer on one surface of the support. On the other surface of the support is a conductive layer and a dye-containing layer. Any resistive material may be used for the resistive support provided it is dimensionally stable and can convert electrical current to heat. The support may be a single, unitized layer or composed of multiple layers. A preferred resistive support comprises a 15 μm thick polycarbonate support containing 30 percent carbon by weight. The conductive layer may be made of any conductive material, such as aluminum.

Any dye can be used in the dye-containing layer provided it is transferable to a dye-receiving element by the action of heat. In a preferred embodiment, a sublimable dye is sued in which the amount of dye which transfers from the resistive ribbon dye-donor to the dye-receiver is in response to the heat level produced by the flow of current applied by the printing electrodes. Examples of such sublimable dyes include those disclosed in U.S. Pat. No. 4,800,399 referred to above and those disclosed in U.S. Pat. No. 4,541,830, the disclosure of which is also hereby incorporated by reference. Such dyes may be employed singly or in combination within the dye layer to obtain a monochrome. The dyes may be used at a coverage of from about 0.05 to about 1 g/m$^2$ and are preferably hydrophobic.

The dye in the resistive ribbon dye-donor element may be dispersed in a polymeric binder such as a cellulose derivative, e.g., cellulose acetate hydrogen phthalate, cellulose acetate, cellulose acetate propionate, cellulose acetate butyrate, cellulose triacetate; a ploycarbonate; poly(styrene-co-acrylonitrile); a poly(sulfone); or a poly(phenylene oxide). The binder may be sued at a coverage of from about 0.1 to about 5 g/m$^2$.

The structure of the liquid lubricant used in the slipping layer does not appear to be a critical factor, as good results have been obtained with lubricants of diverse structures which are liquids at room temperature (e.g. 15°-25° C.) as set forth in the examples below. As demonstrated by the examples, liquid siloxane based compounds (compounds whose structure is made up of alternate silicon and oxygen atoms) such as polysiloxanes and silicones, aliphatic polyoxyethylene partial phosphate esters, liquid hydrocarbon based lubricants, and fatty acid ester oils (mixtures of fatty acids and their esters) are all effective. The liquid lubricants may be used in any amount at which they are effective for their intended purpose. In general, good results are achieved at between about b 0.01 and 20 g/m$^2$, and the preferred range is between about 0.4 to 2.5 g/m$^2$.

A polymeric binder may optionally be included with the liquid lubricant in the slipping layer. There can be employed, for example, poly(vinyl alcohol-co-acetals) such as poly(vinyl alcohol-co-butyral) (available commercially as Butvar 76 ® by Dow Chemical Co.); polystytrene; poly(vinyl acetate); cellulose acetate butyrate; cellulose acetate; ethyl cellulose; bisphenol-A polycarbonate resins; poly(vinyl acetal); poly(vinylbenzal); cellulose triacetate; poly(methylmethacrylate); poly(styrene-co-acrylonitrile); poly(stryren-co-butadiene); etc.

The dye-receiving element that is used with the resistive ribbon dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a polyester, such a spoly(ethylene terephthalate). The support may also be reflective such as titanium dioxide pigmented polyethylene overcoated paper stock, white polyester (polyester with white pigment incorporated therein), an ivory paper, a condenser paper or synthetic paper such as duPont Tyvek ®.

The dye image-receiving layer may comprise, for example, a polycarbonate, a polyturethane, a polyester, polyvinyl chloride, poly(styrene-co-acrylonitrile), poly(caprolactone) or mixtures thereof. The dye image-receiving layer may be present in any amount which is effective for the intended purpose. In general good results have been obtained at a concentration of from about 1 to about 5 g/m$^2$.

As noted above, the resistive ribbon dye-donor elements of the invention are used to form a dye-transfer image. Such a process comprises bringing into contact a dye-receiving element and a dye-donor element as described above to form a dye-transfer assemblage, and imagewise supplying current to the dye-donor element to resistively heat the dye-donor element and cause dye to be transferred from the dye-donor element to the dye-receiving element to form the dye transfer image.

The above assemblage comprising the dye-donor element and dye-receiving element may be preassembled as an integral unit when a monochrome image is to be obtained. This may be done by temporarily adhering the two elements together at their margins. After transfer, the dye-receiving element is then peeled apart to reveal the dye-transfer image.

To facilitate an understanding of the present invention, the following examples are provided to demonstrate the superior results of improved image quality, fred of observed defects, obtained when a liquid lubricant is used as the backing (slipping) layer of a resistive ribbon thermal dye transfer system dye-donor.

EXAMPLES

Cyan dye-donors were prepared as follows: On one side of a 15 μm thick polycarbonate support containing 30 percent carbon by weight (obtainable commercially from Mobay Chemical Division of Bayer AG), an 80 nm thick layer of aluminum was vacuum deposited. On top of the aluminum layer, a subbing layer of duPont-:Tyzor TBT ® (a titanium alkoxide) (0.12 g/m$^2$) was coated form a n-propyl acetate and n-butyl alcohol solvent mixture. On top of this layer a layer of a sublimable cyan dye (0.28 g/m$^2$), in a cellulose a estate propionate binder (2.5% acetyl, 45% propionyl) (0.14 g/m$^2$) was coated for a toluene and 1-propanol solvent mixture.

The dye coated was of the structure:

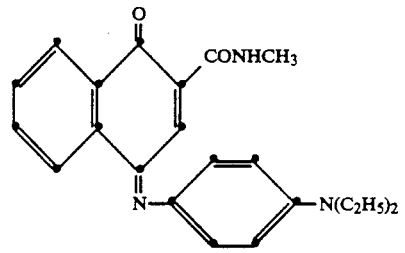

(Cyan Dye)

On the reverse side of the dye-donor, different control, comparison, or invention slipping layers were coated. All layers were coated directly on the polycarbonate support without use of a subbing layer. The liquid lubricants were coated without use of solvent; the solid lubricants were coated from methanol, 1-butanol, 2-propanol, xylene or toluene.

The following liquid lubricants are of the invention:

E-1—BYK Chemie, USA:BYK-320 ® (a polyoxyalkylene-methylalkyl siloxane copolymer)

E-2—Kodak Laboratory Chemicals: Castor Oil (triricinoleoylglycerol)

E-3—Dexzter Corp. (Hysol Div.):Frekote 1711 ® (a liquid silicone mold release agent)

E-4—GAF Corp.: Gafac RA600 ® (an aliphatic polyoxyethylene partial phosphate ester)

E-5—Linseed Oil (a mixture of glycerides of higher unsaturated fatty acids)

E-6—Union Carbide:L-9000 ® (a hydroxy terminated polydimethyl siloxane fluid)

E-7—Dow Corning Corp.:Q2-7119 ® (a polysiloxane fluid)

E-8—General Electric:SF1147 Silicone Fluid ®(a polysiloxane fluid)

E-9—General Electric:SF96-350 Silicone Fluid ®(a dimethylpolysiloxane fluid)

E-10—Sharmrock Chemicals Corp.:Versaflow Base ®(a viscous liquid modified hydrocarbon)

E-11—Shamrock Chemicals Corp.:Versaflow 100 ®(a modified-methylsiloxane)

E-12—Boyle-Midway, Inc.:PAM ® Vegetable Cooking Spray, Butter Flavor

The following control solid lubricants were evaluated:

C-2—Kodak Laboratory Chemicals:Beeswax (an aliphatic ester wax, m.p. approx. 63° C.)

C-3—Kodak Laboratory Chemicals: Carnauba Wax (an aliphatic ester wax with hydroxylated components, m.p. 81°-86°C.)

C-4—Acheson Colloids, Inc.:DAG 154 ®(graphite suspended in a n-butyl alcohol, propylene glycol-methyl ether, 2-propanol solvent)

C5—Dexter Corp. (Hysol Div.):Frekote 1 ®(a fluorotelomer mold release agent and non-silicone dry lubricant)

-6—Asbury Graphite Mills, Inc.:Micro 250 ®(a synthetic graphite of 99.9% carbon with small amounts of silica, aluminum silicate and iron oxide) (2.5 μm average particle diameter)

C-8—Asbury Graphite Mills, Inc.:Graphite 230-U ®(natrual graphite of 96% carbon with small amounts of silica, aluminum silicate and iron oxide) (2.5 μm average particle diameter)

C-8—Asbury Graphite Mills, Inc.:Graphite 230-U ® (natrual graphite of 96% carbon with small amounts of silica, aluminum silicate and iron oxide of particle size 15-25 μm)

C-9—Acheson Colloids Co.:Molydag 210 ®(molybdenum sulfide, 8-13 μm particle diameter in an isopropyl alcohol solvent and thermoplastic binder)

C-10—Dow Corning Corp.:Silicone Release Spray ®(-dimethylpolysiloxane and silicone dioxide in a propellant)

C-11—duPont:Zonyl UR ®(a fluorinated alkyl patial phosphate ester)

Two different dye-receivers were prepared as follows:

Dual-layer dye-receivers were prepared by coating the following layers in order over a a white-reflective support of titanium dioxide pigmented-polyethylene overcoated paper stock with a subbing layer of poly(acrylonitrile-co-vinylindene chloride-co-acrylic acid) (14:790:7 wt ratio) (0.08 g/m) coated from 2-butanone. A dye-receiving layer of Baryer AG:Makrolon 5705 ® (a bisphenol A-polycarbonate resin) J(2.9 g/m$^2$), Union Carbide:Tone PCL-300 (polycaprolactone) (0.38 g/m$^2$), and 1,4-didecoxy-2,6-dimethyoxyphenol (0.38 g/m$^2$) was coated from methylene chloride. An overcoat layer of Union Carbide: Tone PCL-300 (polycaprolactone) (0.11 g/m$^2$), 3M Corp.: FC-431 (a fluorocarbon surfactant ) (0.16 g/m$^2$), Dow Corning DC-510 (silicone fluid) (0.16 g/m$^2$) was coated from methylene chloride.

Mono-layer dye-receivers were prepared by coating on a 175 μm (7 mil) thick white pigmented poly(ehtylene terephthalate) support a dye-receiving layer of Makrolon 5705 ® (a bisphenol-A polycarbonate from Bayer AG) (3.8 g/m$^2$), 1,4-didecoxy-2,5-di-methoxybenzene (0.56 g/m$^2$), and 3M Corp. FC-431 (16 mg/m$^2$) from a dichloromethane and trichloroethylene solvent mixture.

Two types of printing electrodes were used. The first was a single element head of a tungsten carbide rod nominally 50.0 mm long and 3.2 mm in diameter sharpened to a point at an angle of 85 degrees. Alternatively, a 16 element multiple head, similar to that described in U.S. Pat. No. 4,456,915 was constructed from 25 μm thick tungsten foil laminated to a polycarbonate sheet and etched to provide nominally 50 μm electrodes with 100 μm center to center spacing. This sheet was then fastened to a polycarbonate base by Dow Corning No. 739 Silicon Rubber Adhesive. Both electrodes were found to give equivalent test results.

For the single-element head, the dye-side of a dye-donor element strip approximately 10 cm×13 cm in area was placed in contact with the polymeric image-receiver layer side of a dye-receiver element of the same area. This assemblage was taped to a stepper-motor driven 64 mm diameter solid aluminum roller. The printing electrode was pressed with a force of about 8 g against the dye-donor element side of the contact pair pushing it against the roller.

Imaging electronics were activated causing the donor-receiver assemblage to be drawn through the electrode/roller nip at 120 mm/sec. Coincidentally the electrode was pulsed for 19 μsec/pulse at 128 μsec intervals. A ten-step graduated density image was generated by incrementally increasing the current from 15 to 50 ma, resulting in a wattage variation of 0.16 to 0.50 watts.

For the multi-element head, the dye-side of a dye-donor element strip approximately 10 cm×13 cm in area was placed in contact with the polymeric image-receiver layer side of a dye-receiver element of the same area. This assemblage was taped to a stepper-motor driven 64 mm diameter rubber coated aluminum roller. The printing electrode was pressed with a force of about 8 g against the dye-donor element side of the contacted pair pushing it against the roller.

The imaging electronics were activated causing the donor-receiver assemblage to be drawn through the electrode-roller nip at 16 mm/sec. Coincidentally the electrode was pulsed for 19 μsec/pulse at 128 μsec intervals. A ten-step graduated density image was generated by incrementally increasing the number of pulses/dot from 0 to 255. The current supplied to the printing head was approximately 35 ma, resulting in an instantaneous peak power of 10.5 watts/dot and maximum total energy of 0.3 moules/dot. Details of such a pulsed constant current printing process are given in U.S. Pat. No. 4,800,399 referred to above.

After printing by either electrode, the dye-donors were separated from each receiver and the ten-step transferred image was examined for defects. The number of steps within which defects were observed was tabulated (i.e., 10 indicates all 10 steps form Dmin (minimum dye density) to Dmax (maximum dye density) showed a given defect; 3 indicates that 3 steps, usually of higher density showed a given defect; 0 indicates all steps were free of a given defect).

Three distinct problems were observed with the control and comparison slipping layers. Streaks are areas marked with stripes, linear or wavy discolorations or other striations, bands, and lines of color variation. Splotches are areas with irregular spots, blemishes or marks of discoloration of coler variation. Donor-receiver deformation indicates burned and deformed areas produced during the printing process; donors were burned or shreadded with possible aluminum or polycarbonate transferred to the receiver are receivers had a relief image and may also have shown skips due to sticking of the donor to the receiver.

The defects and their magnitude observed with the control (C-1) and comparison (C-b to C-11) lubricants in the slipping layer are tabulated. None of the slipping layers of the invention (E-1 to E-12), showed any defects on any of the 10 steps transferred to the receiver.

| Lubricant | | Defects Observed in Given Number of Steps | | |
|---|---|---|---|---|
| | | Streaks | Splotches | Deformation |
| C-1 | None (control) | 0 | 6 | 2 |
| C-2 | Beeswax (0.52 | 10 | 0 | 0 |
| C-3 | Carnauba wax (0.52 g/m$^2$) | 5 | 3 | 5 |
| C-4 | Graphite suspension (1.2 g/m$^2$) | 0 | 10 | 3 |
| C-5 | Fluorotelomer (0.65 g/m$^2$) | 10 | 0 | 10 |
| C-6 | Graphite (0.39 g/m$^2$) | 0 | 10 | 0* |
| C-7 | Graphite (0.39 g/m$^2$) | 0 | 10 | 0* |
| C-8 | Graphite (0.39 g/m$^2$) | 0 | 10 | 0 |
| C-9 | Molybdenum sulfide (1.2 g/m$^2$) | 10 | 0 | 10 |
| C-10 | Silicone release spray (2.5 g/m$^2$) | 3 | 0 | 3* |
| C-11 | Fluorinated phosphate (1.3 g/m$^2$) | 10 | 5 | 0 |
| E-1 | Silicone copolymer (0.39 g/m$^2$) | 0 | 0 | 0 |
| E-2 | Castor oil (0.39 g/m$^2$) | 0 | 0 | 0 |
| E-3 | Liquid slicone (1.4 g/m$^2$) | 0 | 0 | 0 |

*The use of these materials also gave lower overall density in all transferred steps.

| Lubricant | | Defects Observed in Given Number of Steps | | |
|---|---|---|---|---|
| | | Streaks | Splotches | Deformation |
| E-4 | Partial phosphate ester (0.78 g/m$^2$) | 0 | 0 | 0 |
| E-5 | Linseed oil (0.78 g/m$^2$) | 0 | 0 | 0 |
| E-6 | Polysiloxane fluid (0.39 g/m$^2$) | 0 | 0 | 0 |
| E-7 | Polysiloxane fluid (0.39 g/m$^2$) | 0 | 0 | 0 |
| E-8 | Silicone fluid (0.39 g/m$^2$) | 0 | 0 | 0 |
| E-9 | Silicone fluid (0.39 g/m$^2$) | 0 | 0 | 0 |
| E-10 | Modified hydrocarbon (0.78 g/m$^2$) | 0 | 0 | 0 |
| E-11 | Modified siloxane (0.78 g/m$^2$) | 0 | 0 | 0 |
| E-12 | Cooking spray (0.65 g/m$^2$) | 0 | 0 | 0 |

The specific materials used for the resistive support layer, conductive layer, and dye layer of the resistive ribbon dye-donor element and for the dye-receiving element are not limiting factors in this invention. As disclosed above, liquid lubricants of diverse structure have been found to be effective as slipping layers, indicating the at liquidity at room temperature is the prime consideration, not the structure of the lubricant. The above data demonstrates the unique ability of liquid lubricant slipping layers to enable a satisfactory dye transfer to be achieved by continuous tone resistive ribbon color printing.

The invention has been described in detail with particular reference to preferred embodiments thereof, but it will be understood that variations and modifications can be effected within the spirit and scope of the invention.

What is claimed is:

1. In a resistive ribbon dye-transfer element comprising a resistive support bearing a slipping layer on one side of the resistive support, and a conductive layer and a dye layer on the other side of the resistive support, the improvement wherein the slipping layer comprises a liquid lubricant.

2. The dye-transfer element of claim 1, wherein the liquid lubricant comprises a siloxane based compound.

3. The dye-transfer element of claim 2, wherein the liquid lubricant is a polysiloxane fluid.

4. The dye-transfer element of claim 2, wherein the liquid lubricant comprises a silicone fluid.

5. The dye-transfer element of claim 2, wherein the liquid lubricant comprises a polyoxyalkylene-methylalkyl siloxane copolymer.

6. The dye-transfer element of claim 2, wherein the liquid lubricant comprises a dimethylpolysiloxane fluid.

7. The dye-transfer element of claim 1, wherein the liquid lubricant comprises a hydrocarbon based compound.

8. The dye-transfer element of claim 1, wherein the liquid lubricant comprises an aliphatic polyoxyethylene partial phosphate ester.

9. The dye-transfer element of claim 1, wherein the liquid lubricant comprises a fatty acid ester oil.

10. The dye-transfer element of claim 9, wherein the liquid lubricant comprise castor oil.

11. The dye-transfer element of claim 9, wherein the liquid lubricant comprises linseed oil.

12. The dye-transfer element of claim 1, wherein the liquid lubricant is present at between approximately 0.01 and 20 g/m$^2$.

13. The dye-transfer element of claim 12, wherein the liquid lubricant is present between approximately 0.4 to 2.5 g/m$^2$.

14. The dye-transfer element of claim 1, wherein said dye layer comprises a sublimable dye.

15. In a process of forming a dye-transfer image comprising:

(a) bringing into contact (i) a dye-receiving element and (ii) a dye-donor element comprising a resistive support bearing a slipping layer on one side of the resistive support and a conductive layer and a dye-containing layer on the other side of the resistive support, and (b) imagewise supplying current to said dye-donor element to resistively heat said dye-donor element thereby causing dye from said dye-containing layer to be transferred from said dye-donor element to said dye-receiving element to form said dye-transfer image, the improvement wherein said slipping layer comprises a liquid lubricant.

16. The process of claim 15, wherein the liquid lubricant is present at between approximately 0.01 and 20 $g/m^2$.

17. The process of claim 15, wherein said dye layer comprises a sublimable dye.

18. In a resistive ribbon dye transfer assemblage comprising:

(a) a dye-donor element comprising a resistive support bearing a slipping layer on one side of the resistive supporyt, and a conductive layer and a dye layer on the other side of the resistive support, and (b) a dye-receiving element comprising a dye image-receiving layer in contact with said dye layer, the improvement wherein said slipping layer comprises a liquid lubricant.

19. The assemblage of claim 18, wherein the liquid lubricant is present at between approximately 0.01 and 20 $g/m^2$.

20. The assemblage of claim 18, wherein said dye layer comprises a sublimable dye.

* * * * *